US010603708B2

(12) United States Patent
Fujihira et al.

(10) Patent No.: US 10,603,708 B2
(45) Date of Patent: Mar. 31, 2020

(54) CUSHION PIN

(71) Applicant: HONDA MOTOR CO., LTD., Minato-Ku, Tokyo (JP)

(72) Inventors: Atsushi Fujihira, Tochigi (JP); Takumi Matsuzawa, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 258 days.

(21) Appl. No.: 15/505,876

(22) PCT Filed: Apr. 21, 2015

(86) PCT No.: PCT/JP2015/062052
§ 371 (c)(1),
(2) Date: Feb. 22, 2017

(87) PCT Pub. No.: WO2016/031297
PCT Pub. Date: Mar. 3, 2016

(65) Prior Publication Data

US 2017/0266709 A1 Sep. 21, 2017

(30) Foreign Application Priority Data

Aug. 26, 2014 (JP) ..... 2014-171317

(51) Int. Cl.
*B21D 24/02* (2006.01)
*B21D 22/02* (2006.01)

(52) U.S. Cl.
CPC ..... *B21D 24/02* (2013.01); *B21D 22/02* (2013.01)

(58) Field of Classification Search
CPC ..... B21D 24/02; B30B 15/061; F16F 3/04; F16F 1/02; F16F 1/028
(Continued)

(56) References Cited

U.S. PATENT DOCUMENTS 301,944 A * 7/1884 Winget ..... B60G 11/14 267/289
1,619,069 A * 3/1927 Glasner ..... B21D 24/04 267/119
(Continued)

FOREIGN PATENT DOCUMENTS

CN 201554805 U 8/2010
EP 0 614 711 A1 9/1994
(Continued)

OTHER PUBLICATIONS

Office Action dated Sep. 30, 2019 issued in the corresponding Indian patent application No. 201747003246.

*Primary Examiner* — Adam J Eiseman
*Assistant Examiner* — Bobby Yeonjin Kim
(74) *Attorney, Agent, or Firm* — Carrier Blackman & Associates, P.C.; Joseph P. Carrier; Jeffrey T. Gedeon

(57) ABSTRACT

Provided is a cushion pin which applies sufficient supporting force to a blank holder of a press molding apparatus even if the number of cushion pins and an arrangement region are restricted. A cushion pin (1A) has a cylindrical main body section including a plurality of cylindrical members (2) and annular members (3). The cylindrical members (2) are arranged in series in an axial direction, and the annular members (3) are disposed between the adjacent cylindrical members (2). A rod member (4) and a coil spring (5) are disposed in each the spring chambers of the main body section. The rod member (4) includes a rod-shaped part (4*b*) and a flange part (4*a*). The rod-shaped part (4*b*) has a diameter allowing the rod-shaped part (4*b*) to slidably penetrate through an opening (3*a*) of the annular member (3). The coil spring (5) biases the flange part (4*a*).

4 Claims, 3 Drawing Sheets

(58) Field of Classification Search
USPC ..... 72/453.13; 267/289, 291
See application file for complete search history.

(56) References Cited

U.S. PATENT DOCUMENTS

| | | | | | |
|---|---|---|---|---|---|
| 1,648,394 | A * | 11/1927 | Gates | B60R 19/28 | 267/291 |
| 2,202,050 | A * | 5/1940 | Gibbons | B60R 19/28 | 267/289 |
| 2,547,800 | A * | 4/1951 | West | G05D 23/128 | 236/99 R |
| 2,687,898 | A * | 8/1954 | Schwinn | B62K 25/08 | 267/289 |
| 5,511,868 | A * | 4/1996 | Eftefield | B62D 55/30 | 267/175 |
| 5,725,204 | A * | 3/1998 | Yoshida | F16F 1/12 | 267/221 |
| 7,229,140 | B2 * | 6/2007 | Page | B62D 55/305 | 267/289 |
| 7,261,286 | B2 * | 8/2007 | McConnell | F16F 1/12 | 180/69.21 |
| 8,292,274 | B2 * | 10/2012 | Adoline | F16F 13/002 | 267/168 |
| 8,662,264 | B2 * | 3/2014 | Legeret | B66B 5/18 | 187/375 |

FOREIGN PATENT DOCUMENTS

| | | | |
|---|---|---|---|
| JP | S50-028309 | Y1 | 8/1975 |
| JP | S63-020437 | U | 2/1988 |
| JP | 10-305332 | A | 11/1998 |
| JP | 2004-160519 | A | 6/2004 |

* cited by examiner

CUSHION PIN

TECHNICAL FIELD

The present invention relates to a cushion pin used in a press molding apparatus that performs press molding on a workpiece.

BACKGROUND ART

A press molding apparatus is conventionally known in which a non-processed part of a plate-like workpiece is press-contacted, in a sandwiching manner by an upper die and a blank holder that is provided to surround a lower die, and then press molding is performed on a processed part of the workpiece by the upper die and the lower die.

Also, in such a press molding apparatus, a configuration is well-known in which, in order to prevent occurrence of wrinkle and the like in processing, a blank holder is supported by a plurality of cushion pins disposed below the blank holder, and supporting force that presses the blank holder against the upper die, is applied from the cushion pins to the blank holder.

As the cushion pin supporting the blank holder, a cushion spring (a supporting structure of a molding punch) is well-known. The cushion spring is configured of a cylindrical main body section (a punch case), a coil spring disposed inside the main body section, and a rod (a molding punch) that is disposed to be projectable from an end of the main body section and is biased by the coil spring to project from the main body section (for example, refer to Patent Literature 1).

CITATION LIST

Patent Literature

Patent Literature 1: Japanese Utility Model Publication No. S63-20437

SUMMARY OF INVENTION

Technical Problem

The cushion spring disclosed in Patent Literature 1, however, includes only one coil spring (an elastic member) disposed inside the main body section. Thus, when the movement of the blank holder is small, the cushion spring may not apply sufficient supporting force to the blank holder in some cases.

In addition, to obtain sufficient supporting force, a configuration in which a plurality of coil springs are arranged in parallel with one another inside the main body section, separately from the above-described cushion spring has been proposed. When the coil springs are arranged in parallel with one another, however, the main body section is increased in size in the arrangement direction. Thus, it is difficult to obtain sufficient supporting force when the number of cushion pins to be arranged and the arrangement region of the cushion pins are restricted.

The present invention is made in consideration of the above-described difficulties, and it is an object of the present invention to provide a cushion pin that makes it possible to apply sufficient supporting force to a blank holder of a press molding apparatus even when the number of cushion pins to be arranged and the arrangement region of the cushion pins are restricted.

Solution to Problem

A cushion pin according to the present invention comprises: a cylindrical main body section; a plurality of annular partition walls arranged, inside the main body section, at predetermined intervals in an axial direction of the main body section, the annular partition walls forming a plurality of spring chambers; a coil spring disposed in each of the spring chambers; and a rod disposed to pass through an opening of the partition wall inside the main body section, at least one end of the rod projecting from the main body section, in which the rod includes a rod part having a diameter that allows the rod part to be slidable through the opening, and a plurality of flange parts, and each of the flange parts is located inside each of the spring chambers, and is biased by the coil spring.

As mentioned above, in the cushion pin of the present invention, the coil spring is disposed in each of the plurality of spring chambers formed inside the main body section, and these coil springs bias one rod while being supported by the partition walls. Therefore, the cushion pin according to the present invention applies, to the rod, supporting force similar to that in a case in which the coil springs are arranged in parallel with one another even though the coil springs are arranged in series with one another.

Also, the position at which the rod is biased by the coil spring is dispersed to a plurality of positions that are closer to the center than the end of the rod. This makes buckling of the rod hard to occur.

Therefore, according to the cushion pin of the present invention, it is possible to apply sufficient supporting force to the blank holder of the press molding apparatus even when the number of cushion pins to be arranged and the arrangement region of the cushion pins are restricted.

Also, in the cushion pin according to the present invention, the main body section may be preferably configured by coupling a plurality of cylindrical members, and the plurality of cylindrical members may be preferably disposed such that respective central axes of the cylindrical members are aligned on a common axis.

Such a configuration makes it easy to insert the rod and the coil spring into the inside of the main body section. Thus, assembling of the cushion pin becomes easy.

Further, in the cushion pin according to the present invention, the main body section may be preferably provided separately from the partition wall.

The partition wall and the main body section may be integrally formed; however, when the partition wall is separately provided from the main body section, the rod and the coil spring are easily inserted into the inside of the main body section, which makes it easy to assemble the cushion pin.

Furthermore, in the cushion pin according to the present invention, the rod part may be preferably configured of a plurality of rod members that are arranged in the axial direction of the main body section.

Such a configuration suppresses stress concentration, and makes it possible to improve durability of the rod, as compared with the case in which the rod part is configured of one member. Also, such a configuration makes it possible to assemble the rod together with the configuration of the spring chamber (namely, attaching of the partition wall). Thus, assembling becomes easy.

Furthermore, when the main body section is also configured of a plurality of cylindrical members, the number of coil springs and partition walls (namely, the number of spring chambers), the number of rod members (namely, the length of the rod), and the number of cylindrical members (namely, the length of the main body section) are easily changed. This makes it possible to configure cushion pins with various lengths by using the same members.

Also, in the present invention, in the case in which the rod is configured of a plurality of rod members, each of the rod members may preferably include a flange part and a rod-shaped part that extends toward a side opposite to the coil spring biasing the flange part.

When the rod member is configured as mentioned above, the adjacent rod members come into contact with each other through the flange part and the front end of the rod-shaped part. This hardly causes displacement of the axis of the rod part from the axis of the main body section. As a result, sliding of the rod is hard to be inhibited during application of the supporting force from the cushion pin to the blank holder.

Also, in the cushion pin according to the present invention, a guide bush may be preferably provided in the opening of the partition wall.

Such a configuration makes the sliding of the rod hard to be inhibited.

Also, in the cushion pin according to the present invention, it is preferable to comprise an outer cylindrical member in which the main body section is disposed.

When the cushion pin is configured to have a double structure of the main body section and the outer cylindrical member as mentioned above, strength of the cushion pin is easily enhanced.

DESCRIPTION OF EMBODIMENTS

First Embodiment

First, a press molding apparatus 10 using a cushion pin 1A according to the present embodiment is described with reference to FIG. 1.

Figure 1:
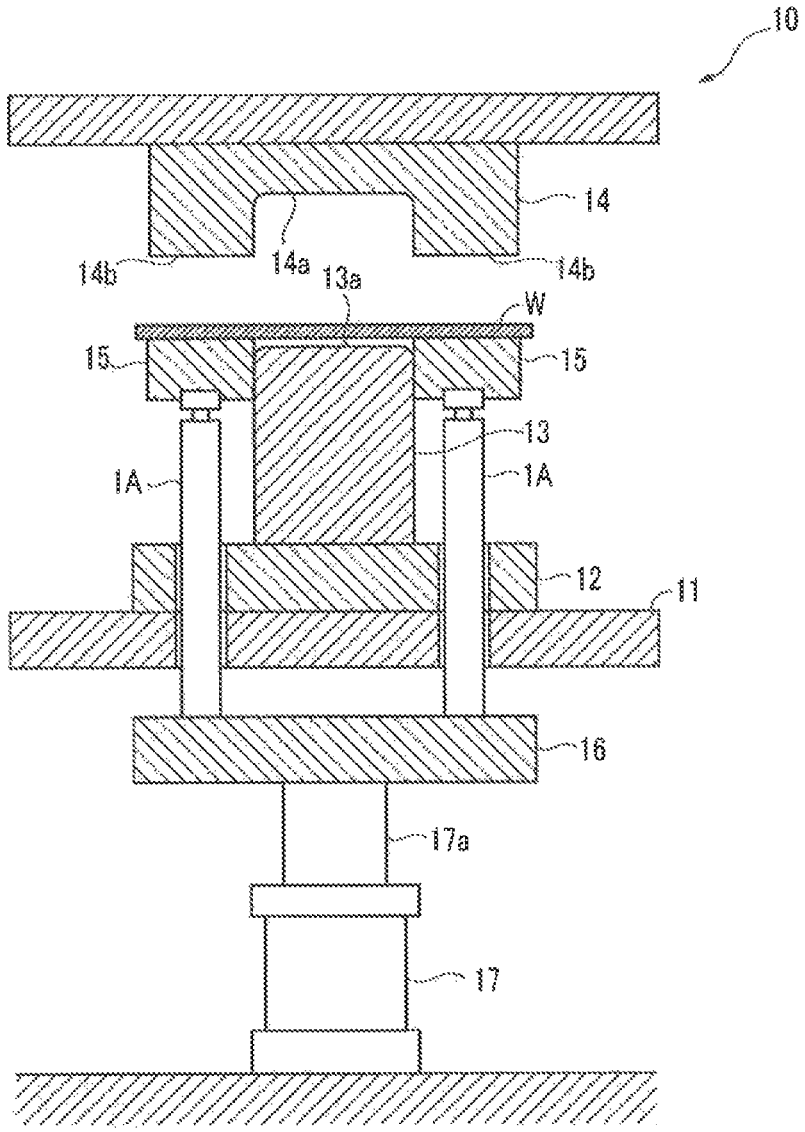
FIG. 1 is a cross-sectional diagram illustrating a schematic configuration of a press molding apparatus using a cushion pin according to a first embodiment of the present invention.

As illustrated in FIG. 1, the press molding apparatus 10 includes: a bolster 12 fixed on a die bed 11; a lower die 13 fixed on the bolster 12; and an upper die 14 liftably provided above the lower die 13.

The lower die 13 includes a bottom surface molding part 13*a* that projects upward. The upper die 14 includes a top surface molding part 14*a* that has a concave cross-sectional surface corresponding to the bottom surface molding part 13*a*. The upper die 14 is descended by an unillustrated lifting unit to press a plate-like workpiece W.

A liftable blank holder 15 having an annular shape is provided around the bottom surface molding part 13*a* of the lower die 13. The blank holder 15 is provided to face to a workpiece pressing surface 14*b* that is provided on outer circumference of the top surface molding part 14*a* of the upper die 14.

The workpiece W is placed on the blank holder 15, and a non-processed part of the workpiece W is sandwiched between the workpiece pressing surface 14*b* and the blank holder 15 through descent of the upper die 14. The workpiece W is subjected to press molding by the bottom surface molding part 13*a* and the top surface molding part 14*a* while being sandwiched between the workpiece pressing surface 14*b* and the blank holder 15.

When the workpiece pressing surface 14*b* and the blank holder 15 sandwich the workpiece W, supporting force is applied to the blank holder 15 from the cushion pin 1A described later. This suppresses excessive flow-in of a material in the molding of the workpiece W to inhibit occurrence of wrinkle and the like.

The lower die 13 and the upper die 14 of the press molding apparatus 10 are exchangeable depending on the molded shape of the workpiece W. When the lower die 13 and the upper die 14 are exchanged, the shapes of the bottom surface molding part 13*a* and the top surface molding part 14*a* are changed to shapes different from those before the exchange. Therefore, the blank holder 15 is also exchanged to other blank holder having a shape corresponding to the exchanged lower die 13 and the exchanged upper die 14.

A cushion plate 16 is horizontally provided below the die bed 11. The cushion plate 16 is supported by a cushion cylinder 17 that is provided below the cushion plate 16.

The cushion cylinder 17 supporting the cushion plate 16 includes a piston rod 17*a* that extends and contracts along an axial direction of the cushion cylinder 17. The cushion plate 16 is coupled with an upper end of the piston rod 17*a*, and ascends and descends in conjunction with ascending and descending of the piston rod 17*a*.

The blank holder 15 is supported by a plurality of cushion pins 1A on the cushion plate 16. The supporting positions and the number of the cushion pins 1A are changeable depending on the shape of the blank holder 15.

The cushion cylinder 17 generates upward biasing force, and the biasing force is transmitted to the cushion plate 16, the cushion pins 1A, and the blank holder 15. In contrast, the supporting force from the cushion pins 1A is applied to the blank holder 15. The supporting force at this time is set according to the molded shape, a kind of material, and the like, of the workpiece W.

Next, the cushion pin 1A according to the present embodiment is described with reference to FIG. 2.

Figure 2:
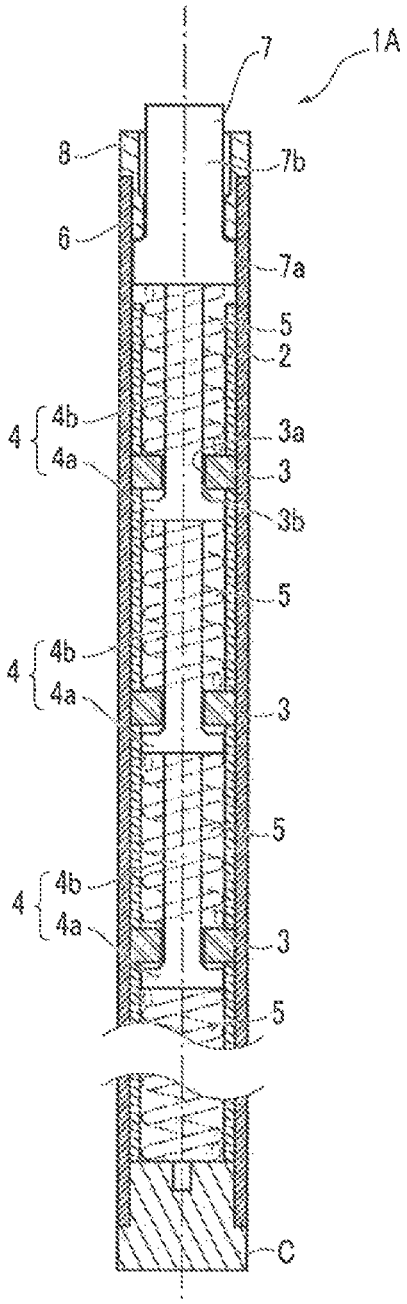
FIG. 2 is a cross-sectional diagram illustrating a schematic configuration of the cushion pin of FIG. 1.

As illustrated in FIG. 2, the cushion pin 1A includes: a plurality of cylindrical members 2 that are disposed such that respective central axes of the cylindrical members 2 are aligned on a common straight line; and a plurality of annular members 3 that have respective central axes coincident with the central axes of the cylindrical members 2 and are disposed to be sandwiched between the adjacent cylindrical members 2.

Each of the annular members 3 has a circular opening 3*a* at a center thereof. In addition, a guide bush 3*b* is fitted into the opening 3*a*. Providing the guide bush 3*b* makes sliding of a rod-shaped part 4*b* of a rod member 4 described later hard to be inhibited.

A main body section of the cushion pin 1A is configured of the cylindrical members 2 and the parts of the annular members 3 sandwiched between the cylindrical members 2. A partition wall of the cushion pin 1A is formed of parts of the annular member 3 projecting toward inner surface side of the cylindrical member 2. Therefore, the main body section has a structure in which the partition walls are provided, inside the main body section, at predetermined intervals in the axial direction of the main body section. In addition, a lower end part of the main body section is sealed by a cap screw C.

A plurality of spring chambers are formed inside the main body section by the partition walls, the cap screw C, and a piston member 7 described later. The rod member 4 and a coil spring 5 are disposed in each of the spring chambers.

The rod member 4 includes a disc-shaped flange part 4*a* and a rod-shaped part 4*b*. The flange part 4*a* has a diameter larger than a diameter of the opening 3*a* of the annular member 3. The rod-shaped part 4*b* has a diameter allowing the rod-shaped part 4*b* to be slidable through the opening 3*a*, and extends from the flange part 4*a* toward the blank holder 15 (toward a front end of the piston member 7 in FIG. 2, hereinafter referred to as "upper side").

A rod of the cushion pin 1A is configured by arranging the plurality of rod members 4 in the axial direction of the main body section. Thus, the rod includes one rod part configured of a plurality of rod-shaped parts 4*b*, and the plurality of flange parts 4*a*. The rod having such a configuration is so disposed as to pass through the opening 3*a* of the partition wall inside the main body section, and an upper end of the rod projects from an opening on the upper side of the cylindrical main body section.

An upper end of the coil spring 5 comes into contact with, on the side opposite to the blank holder 15 side (the cap screw C side in FIG. 1, hereinafter, referred to as "lower side"), the flange part 4*a* of the rod member 4 that is disposed together with the coil spring 5 in the spring chamber. In contrast, a lower end of the coil spring 5 comes into contact with the cap screw C or the lower partition wall out of the partition walls configuring the spring chamber in which the coil spring 5 is disposed.

The main body section that is configured of the cylindrical members 2 and the parts of the annular members 3 sandwiched between the cylindrical members 2 is disposed inside an outer cylindrical member 6. The cushion pin 1A of the present embodiment is provided with the outer cylindrical member 6, thereby having a double structure of the cylindrical part. Thus, strength of the cushion pin 1A is higher than a cushion pin not including the outer cylindrical member 6, and therefore hardly causes buckling when the supporting force is applied from the cushion pin 1A to the blank holder 15.

The outer cylindrical member 6 is formed longer than the main body section in the axial direction. The piston member 7 is so disposed on the upper side of the main body section as to be slidable in the axial direction of the main body section inside the upper end of the outer cylindrical member 6. The piston member 7 is a member that comes into contact with the blank holder 15 when the cushion pin 1A is disposed in the press molding apparatus. The supporting force is applied to the blank holder 15 through the piston member 7.

The piston member 7 includes a disc-shaped large-diameter part 7*a* and a small-diameter part 7*b* that extends upward from a center of the large-diameter part 7*a*. The upper end of the rod (more specifically, the uppermost rod member 4 out of the rod members 4 configuring the rod) and the upper end of the coil spring 5 disposed on uppermost side come into contact with a lower end surface of the large-diameter part 7*a*. The blank holder 15 comes into contact with an upper end surface of the small-diameter part 7*b*.

An annular cap member 8 is fitted into the upper end of the outer cylindrical member 6 in order to regulate sliding of the piston member 7. The small-diameter part 7*b* of the piston member 7 is slidably fitted into an opening of the cap member 8. An upper circumferential part of the large-diameter part 7*a* of the piston member 7 comes into contact with a lower end of the cap member 8.

A predetermined distance is provided between a lower end surface of the cap member 8 and the upper end surface of the main body section (more specifically, the cylindrical member 2 on the most blank holder 15 side out of the cylindrical members 2 configuring the main body section). The large-diameter part 7*a* comes into contact with these end surfaces, which regulates a slidable range of the piston member 7.

In the cushion pin 1A having such a configuration, the piston member 7 moves downward at maximum to a position at which the lower end of the large-diameter part 7*a* of the piston member 7 comes into contact with the upper end of the main body section in the press molding (in other words, when the piston member 7 is pushed from the above).

At this time, in each of the spring chambers, the upper biasing force is applied to one rod from the plurality of coil springs 5 that are supported by respective independent partition walls. This causes the supporting force similar to that of the case in which the coil springs 5 are arranged in parallel with one another, to be applied to the rod configured of the plurality of rod members 4 even though the plurality of coil springs 5 are arranged in series with one another.

Also, the position at which the rod is biased by the coil springs 5 is dispersed to a plurality of positions that are closer to the center rather than the end of the rod. This makes buckling of the rod hard to occur.

Therefore, according to the cushion pin 1A of the present embodiment, it is possible to apply sufficient supporting force to the blank holder 15 even if the number of cushion pins 1A to be arranged and the arrangement region of the cushion pins 1A are restricted.

Second Embodiment

A cushion pin 1B according to the present embodiment is described with reference to FIG. 3. Note that the cushion pin 1B of the present embodiment is different from the cushion pin 1A of the first embodiment only in configuration of the main body section. Thus, only this configuration is described in detail. Further, components similar to those of the cushion pin 1A of the first embodiment are denoted by the same reference numerals, and the description thereof is omitted.

Figure 3:
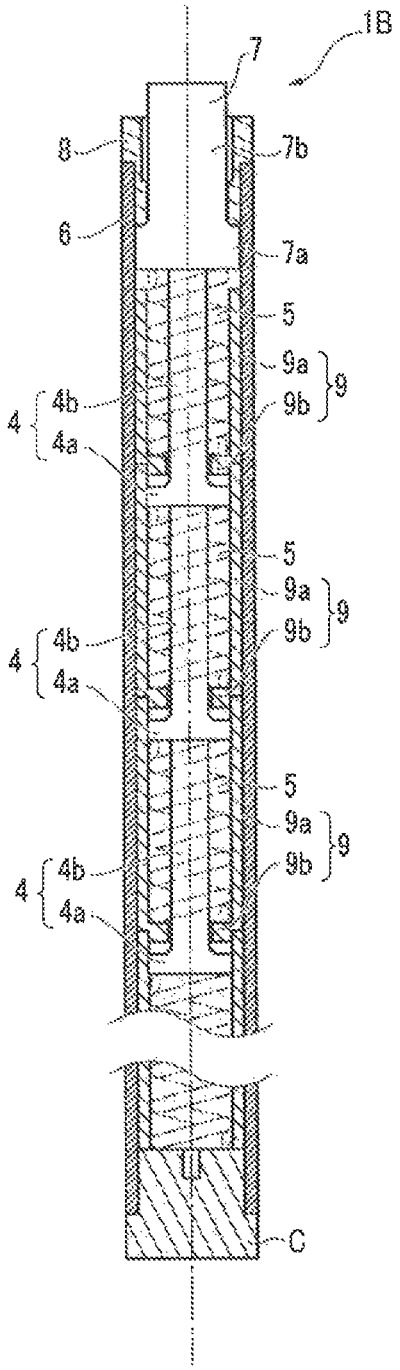
FIG. 3 is a cross-sectional diagram illustrating a schematic configuration of a cushion pin according to a second embodiment of the present invention.

As illustrated in FIG. 3, in the cushion pin 1B, the main body section and the partition walls are configured by a plurality of cylindrical members 9 that are disposed such that respective central axes of the cylindrical members 9 are aligned on a common straight line. Each of the cylindrical members 9 includes a large-diameter part 9*a* and a small-diameter part 9*b*. The large-diameter part 9*a* has an outer diameter corresponding to an inner diameter of the outer cylindrical member 6. The small-diameter part 9*b* is coupled with a lower end of the large-diameter part 9*a* and has an outer diameter corresponding to an inner diameter of the large-diameter part 9*a*.

One cylindrical member 9 is connected with the adjacent cylindrical member 9 that is disposed above the one cylindrical member 9 through insertion of the small-diameter part 9*b* of the adjacent cylindrical member 9 into the upper end of the large-diameter part 9*a* of the one cylindrical member 9. At this time, the small-diameter part 9*b* projects toward an inner circumferential surface of the main body section that is configured through connection of the cylindrical members 9, and serves as a partition wall to form the spring chamber.

The cushion pin 1B of the present embodiment having such a configuration also exhibits action and effects similar to those of the cushion pin 1A of the first embodiment.

Hereinbefore, the illustrated embodiments have been described; however, the present invention is not limited to such embodiments.

In the above-described first embodiment, the main body section is configured by sandwiching the annular member 3 between the adjacent cylindrical members 2. In addition, in the above-described second embodiment, the main body section is configured by connecting the plurality of cylindrical members 9 with one another. The main body section of the present invention, however, is not limited to such configurations. For example, a member in which a cylindrical member and a partition wall are integrally formed may serve as the main body section, or a ring-shaped member may be fitted into an inside of a cylindrical member to form a partition wall.

Also, in the above-described embodiments, the rod is configured of the plurality of rod members 4. The rod of the present invention, however, is not limited to such a configuration. For example, the rod may be formed by fitting a rod-shaped member into a ring-shaped member. Alternatively, a member in which a rod part and a flange part are integrally formed may be used as a rod. Note that stress concentration may easily occur in the rod configured of one member as compared with a rod configured of a plurality of members.

In addition, in the above-described embodiments, each of the cushion pins 1A and 1B has the outer cylindrical member 6, the piston member 7, and the cap member 8. The cushion pin of the present invention, however, is not limited to such a configuration, and these members are not necessarily provided.

REFERENCE SIGNS LIST

C . . . Cap screw, W . . . Workpiece, 10 . . . Press molding apparatus, 11 . . . Die bed, 12 . . . Bolster, 13 . . . Lower die, 13*a* . . . bottom surface molding part, 14 . . . Upper die, 14*a* . . . Top surface molding part, 14*b* . . . Workpiece pressing surface, 15 . . . Blank holder, 16 . . . Cushion plate, 17 . . . Cushion cylinder, 17*a* . . . Piston rod, 1A, 1B . . . Cushion pin, 2 . . . Cylindrical member, 3 . . . Annular member, 3*a* . . . Opening, 3*b* . . . Guide bush, 4 . . . Rod member, 4*a* . . . Flange part, 4*b* . . . Rod-shaped part, 5 . . . Coil spring, 6 . . . Outer cylindrical member, 7 . . . Piston member, 7*a* . . . Large-diameter part, 7*b* . . . Small-diameter part, 8 . . . Cap member, 9 . . . Cylindrical member, 9*a* . . . Large-diameter part, 9*b* . . . Small-diameter part.

The invention claimed is:

1. A cushion pin used in a press molding apparatus that performs pressing molding on a workpiece, comprising:

a plurality of cylindrical members disposed to allow respective central axes of the cylindrical members to be aligned on a common axis;

a plurality of annular partition walls arranged, at predetermined intervals in an axial direction of the plurality of cylindrical members, the annular partition walls together with the cylindrical members forming a plurality of spring chambers;

a plurality of coil springs each of which being disposed in each of the plurality of spring chambers;

a plurality of rod members with each rod member of the plurality of rod members arranged in respective spring chambers of the plurality of spring chambers and arranged in the axial direction of the plurality of cylindrical members; and an outer cylindrical member in which the plurality of cylindrical members and the plurality of rod members are arranged inside thereof, wherein each of the plurality of rod members include a rod shaped part which is slidably inserted into an opening of the partition wall on one side of the spring chamber in which the rod shaped part is arranged, and a flange part which is located inside the spring chamber, and is biased by the coil spring arranged in the spring chamber to one side of the axial direction of the plurality of cylindrical members, an end face of one side of the rod shaped part is always maintained in a state of contact with an end face of a flange part of an adjacent rod member, the rod shaped part extends toward the one side of the axial direction from the flange part, and the rod shaped part of the rod member positioned closest to the one side of the axial direction among the plurality of rod members, projects from the cylindrical member positioned closest to the one side of the axial direction among the plurality of cylindrical members.

2. The cushion pin according to claim 1, wherein the cylindrical members and the partition walls are separately provided.

3. The cushion pin according to claim 1, wherein the opening of the partition wall is provided with a guide bush.

4. A cushion pin used in a press molding apparatus that performs press molding on a workpiece, comprising:

a plurality of cylindrical members disposed to allow respective central axes of the cylindrical members to be aligned on a common axis;

a plurality of annular partition walls arranged, at predetermined intervals in an axial direction of the plurality of cylindrical members, the annular partition walls together with the cylindrical members forming a plurality of spring chambers;

a plurality of coil springs each of which being disposed in each of the plurality of spring chambers;

a plurality of rod members with each rod member of the plurality of rod members arranged in respective spring chambers of the plurality of spring chambers and arranged in the axial direction of the plurality of cylindrical members; and an outer cylindrical member in which the plurality of cylindrical members and the plurality of rod members are arranged inside thereof, wherein the plurality of cylindrical members have an outer diameter corresponding to an inner diameter of the outer cylindrical member, each of the plurality of rod members include a rod-shaped part which is slidably inserted into an opening of the partition wall on one side of the spring chamber in which the rod-shaped part is arranged, and a flange part which is located inside the spring chamber, and is biased by the coil spring arranged in the spring chamber to one side of the axial direction of the plurality of cylindrical members, an end face of one side of the rod-shaped part is always maintained in a state of contact with an end face of a flange part of an adjacent rod member, the rod-shaped part extends toward the one side of the axial direction from the flange part, the rod-shaped part of the rod member positioned closest to the one side of the axial direction among the plurality of rod members, projects from the cylindrical member positioned closest to the one side of the axial direction among the plurality of cylindrical members, and wherein the cushion pin further includes a piston member which contacts the rod-shaped part of the rod member positioned closest to the one side of the axial direction, the piston member having a diameter which corresponds to the inner diameter of the outer cylindrical member.

* * * * *